US010177477B2

(12) United States Patent
Fu et al.

(10) Patent No.: US 10,177,477 B2
(45) Date of Patent: Jan. 8, 2019

(54) CONNECTOR AND CONNECTOR ASSEMBLY

(71) Applicant: Tyco Electronics (Shanghai) Co. Ltd., Shanghai (CN)

(72) Inventors: Xiaozhi Fu, Shanghai (CN); Ming Shi, Shanghai (CN); Xiang Xu, Shanghai (CN); Wei Zhang, Shanghai (CN); Cui Li, Shanghai (CN)

(73) Assignee: Tyco Electronics (Shanghai) Co. Ltd., Shanghai (CN)

( * ) Notice: Subject to any disclaimer, the term of this patent is extended or adjusted under 35 U.S.C. 154(b) by 0 days.

(21) Appl. No.: 15/647,582

(22) Filed: Jul. 12, 2017

(65) Prior Publication Data

US 2018/0019530 A1 Jan. 18, 2018

(30) Foreign Application Priority Data

Jul. 12, 2016 (CN) ..... 2016 2 0728627 U

(51) Int. Cl.

| | |
|---|---|
| ***H01R 9/05*** | (2006.01) |
| ***H01R 12/73*** | (2011.01) |
| ***H01R 12/70*** | (2011.01) |
| ***H01R 12/91*** | (2011.01) |
| ***H01R 13/58*** | (2006.01) |
| ***H01R 12/57*** | (2011.01) |
| ***H01R 13/11*** | (2006.01) |
| *H01R 4/48* | (2006.01) |

(52) U.S. Cl.

CPC ..... *H01R 12/73* (2013.01); *H01R 12/57* (2013.01); *H01R 12/707* (2013.01); *H01R 12/732* (2013.01); *H01R 12/91* (2013.01); *H01R 13/11* (2013.01); *H01R 13/5812* (2013.01); *H01R 13/5829* (2013.01); *H01R 4/4836* (2013.01)

(58) Field of Classification Search

CPC ..... H01R 12/73; H01R 12/91; H01R 12/707; H01R 9/0515; H01R 13/5812; H01R 13/5829; H01R 23/7073; H01R 24/50; H01R 24/52; H01R 2103/00

USPC ..... 439/591, 581, 63, 902

See application file for complete search history.

(56) References Cited

U.S. PATENT DOCUMENTS 5,169,343 A * 12/1992 Andrews ..... H01R 23/688 439/581
5,310,354 A * 5/1994 Oswald, Jr. ..... H01R 24/50 439/108
6,764,349 B2 * 7/2004 Provencher ..... H01R 13/6587 439/607.05

(Continued)

OTHER PUBLICATIONS

Certificate of Utility Model Patent, Patent No. ZL201620728627.3, Application date Jul. 12, 2016, 12 pages.

*Primary Examiner* — Abdullah Riyami
*Assistant Examiner* — Vladimir Imas
(74) *Attorney, Agent, or Firm* — Barley Snyder

(57) ABSTRACT

A connector assembly comprises a first connector and a second connector. The first connector consists of a first monolithically formed conductive terminal adapted to be soldered onto a first circuit board. The second connector consists of a second monolithically formed conductive terminal adapted to be soldered onto a second circuit board. The first connector mates with the second connector to electrically connect the first circuit board to the second circuit board.

15 Claims, 3 Drawing Sheets

(56) References Cited

U.S. PATENT DOCUMENTS

| | | | | |
|---|---|---|---|---|
| 7,059,907 | B2 * | 6/2006 | Winings | H01R 12/732 439/607.05 |
| 7,285,004 | B1 * | 10/2007 | Fukuda | H01R 13/6272 439/354 |
| 7,563,103 | B1 * | 7/2009 | Hall | H01R 24/50 439/581 |
| 7,896,655 | B1 * | 3/2011 | Blasick | H01R 13/112 439/581 |
| 8,282,415 | B1 * | 10/2012 | Foltz | H01R 13/514 439/579 |
| 8,939,794 | B2 * | 1/2015 | Mason | H01R 9/0515 439/581 |
| 9,368,895 | B2 * | 6/2016 | Ueno | H01R 12/79 |

* cited by examiner

CONNECTOR AND CONNECTOR ASSEMBLY

CROSS-REFERENCE TO RELATED APPLICATION

This application claims the benefit of the filing date under 35 U.S.C. § 119(a)-(d) of Chinese Patent Application No. 201620728627.3, filed on Jul. 12, 2016.

FIELD OF THE INVENTION

The present invention relates to a connector assembly and, more particularly, to a connector assembly electrically connecting two circuit boards.

BACKGROUND

In the prior art, a connector assembly for electrically connecting two circuit boards comprises a first connector, a second connector, and an intermediate bridge insert. The first connector has a first insulative housing and a first electrically conductive terminal disposed within the first insulative housing. The second connector has a second insulative housing and a second electrically conductive terminal disposed within the second insulative housing. The first electrically conductive terminal of the first connector has a first weld pin welded onto a first circuit board. The second electrically conductive terminal of the second connector has a second weld pin welded onto a second circuit board. The intermediate bridge insert has one end inserted into the first connector electrically contacting the first electrically conductive terminal and the other end inserted into the second connector electrically contacting the second electrically conductive terminal.

The known connector assembly electrically connects the first and second circuit boards. The first and second insulative housings, however, are complicated to manufacture, increasing a manufacturing cost of the connector assembly. The intermediate bridge insert is a member manufactured separately from the first and second connectors, complicating the connection formed by the connector assembly and further increasing the manufacturing cost of the connector assembly.

SUMMARY

A connector assembly according to the invention comprises a first connector and a second connector. The first connector consists of a first monolithically formed conductive terminal adapted to be soldered onto a first circuit board. The second connector consists of a second monolithically formed conductive terminal adapted to be soldered onto a second circuit board. The first connector mates with the second connector to electrically connect the first circuit board to the second circuit board.

BRIEF DESCRIPTION OF THE DRAWINGS

The invention will now be described by way of example with reference to the accompanying Figures, of which.

DETAILED DESCRIPTION OF THE EMBODIMENT(S)

Figure 1:
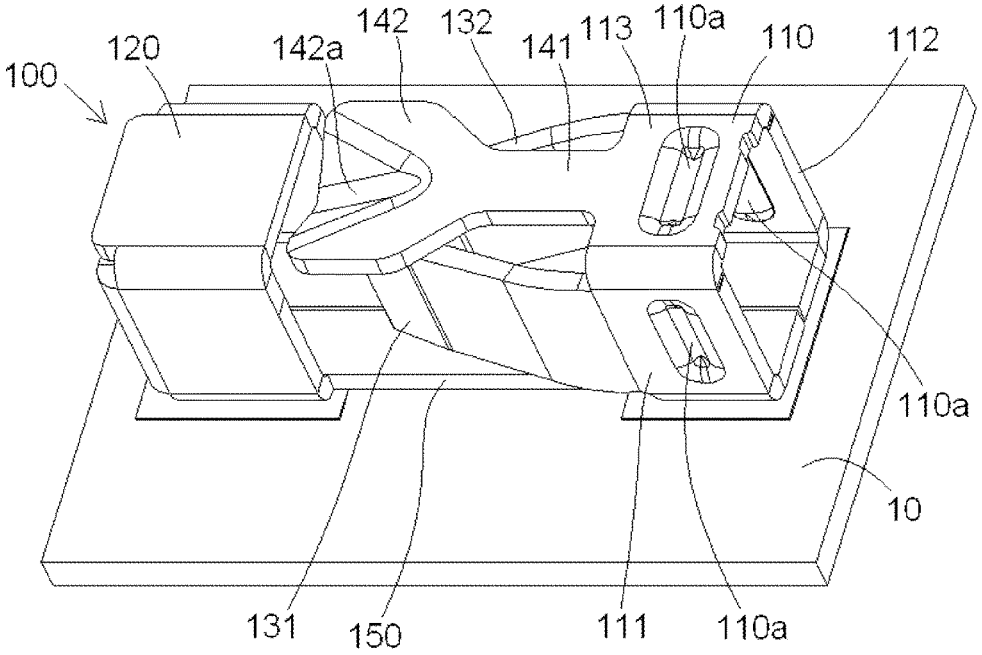
FIG. 1 is a perspective view of a first connector according to the invention.

Embodiments of the present invention will be described hereinafter in detail with reference to the attached drawings, wherein like reference numerals refer to the like elements. The present invention may, however, be embodied in many different forms and should not be construed as being limited to the embodiments set forth herein; rather, these embodiments are provided so that the disclosure will be thorough and complete and will fully convey the concept of the invention to those skilled in the art.

Figure 2:
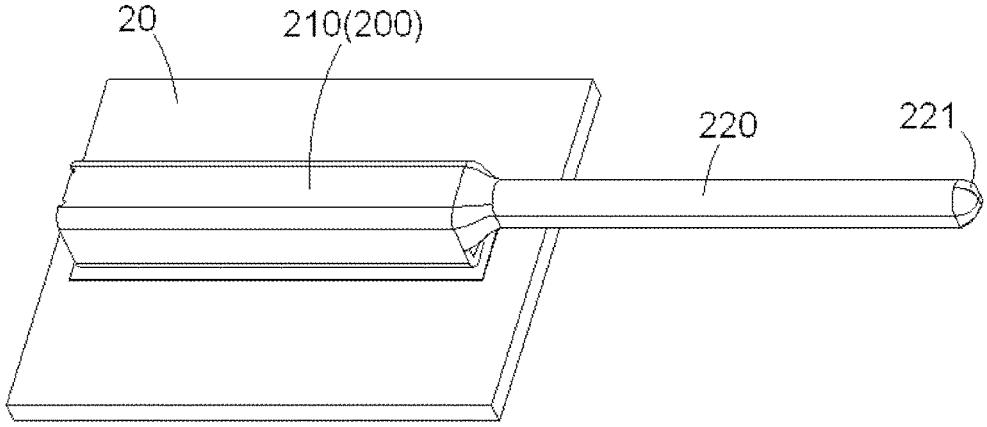
FIG. 2 is a perspective view of a second connector according to the invention.
Figure 3:
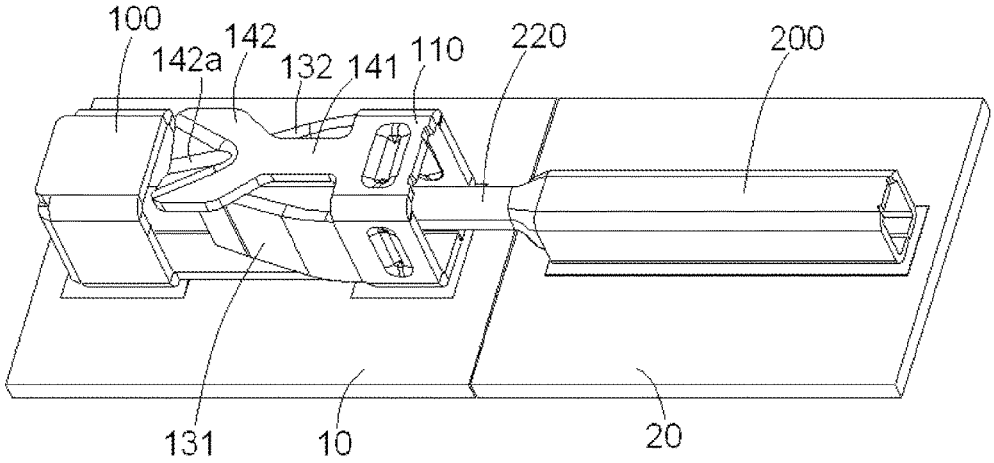
FIG. 3 is a perspective view of a connector assembly according to the invention comprising the first connector and the second connector.

A connector assembly according to the invention includes a first connector 100 and a second connector 200 connecting a first circuit board 10 to a second circuit board 20 as shown in FIGS. 1-3.

The first connector 100 is shown in FIG. 1 and the second connector 200 is shown in FIG. 2. As shown in FIGS. 1 and 2, each of the first connector 100 and the second connector 200 consists only of a monolithically formed conductive terminal. In the shown embodiment, the first connector 100 is a female connector and the second connector 200 is a male connector. In other embodiments, as would be understood by one with ordinary skill in the art, the first connector 100 could be a male connector and the second connector 200 could be a female connector.

The first connector 100, as shown in FIG. 1, has a first end 110 and an opposite second end 120. The first end 110 has a pair of side walls 111, 112, a top wall 113, and a bottom wall. The top wall 113 is a planar surface permitting suction by a suction nozzle. A plurality of protrusions 110*a* are disposed on the side walls 111, 112 and the top wall 113 and protrude inwardly at the first end 110. The first connector 100 has a pair of elastic clamps 131, 132. Each elastic clamp 131, 132 extends in a longitudinal direction of the first connector 100 from one of the side walls 111, 112 toward the second end 120. The first connector 100 has a bottom plate 150 connecting the bottom wall of the first end 110 and a bottom wall of the second end 120. As shown in FIG. 1, each of the first end 110 and the second end 120 of the first connector 100 has a planar bottom surface soldered onto a surface of the first circuit board 10.

The first connector 100, as shown in FIG. 1, has a release mechanism 141, 142, 142*a* including an elastic cantilever 141, a pressing portion 142 disposed on an end of the elastic cantilever 141, and a wedge-shaped protrusion 142*a* disposed on the pressing portion 142. The elastic cantilever 141 extends from the top wall 113 of the first end 110 in the longitudinal direction of the first connector 100 toward the second end 120.

The release mechanism 141, 142, 142*a* is movable to separate the elastic clamps 131, 132. When the pressing portion 142 is moved in a vertical direction orthogonal to the longitudinal direction of the first connector 100, the wedge-shaped protrusion 142*a* is inserted between the pair of elastic clamps 131, 132 and opens the pair of elastic clamps 131, 132 away from each other in a transverse direction. Each of the elastic clamps 131, 132 has a guiding bevel (not shown) on an end thereof to guide the wedge-shaped protrusion 142*a* to be smoothly inserted between the elastic clamps 131, 132.

The second connector 200, as shown in FIG. 2, has a body 210 and a rod plug 220 extending from the body 210. The body 210 has a planar top surface permitting suction by a suction nozzle. The rod plug 220 has a smooth arced end 221 opposite the body 210. As shown in FIG. 2, the body 210 of the second connector 200 has a planar bottom surface soldered onto a surface of the second circuit board 20.

As shown in FIG. 3, the second connector 200 attached to the second circuit board 20 is mated with the first connector 100 attached to the first circuit board 10 to electrically connect the first circuit board 10 and the second circuit board 20. The rod plug 220 of the second connector 200 is inserted into the first end 110 of the first connector 100 and between the elastic clamps 131, 132. The smooth arced end 221 allows the rod plug 220 to be inserted smoothly between the elastic clamps 131, 132. The rod plug 220 is in contact with and held by the elastic clamps 131, 132 to form the electrical connection between the circuit boards 10, 20.

To release the rod plug 220, the pressing portion 142 is moved in the vertical direction and the wedge-shaped protrusion 142*a* separates the elastic clamps 131, 132 in the transverse direction away from each other, releasing the rod plug 220 clamped by the elastic clamps 131, 132 and permitting withdrawal of the second connector 200 from the first connector 100.

Figure 4:
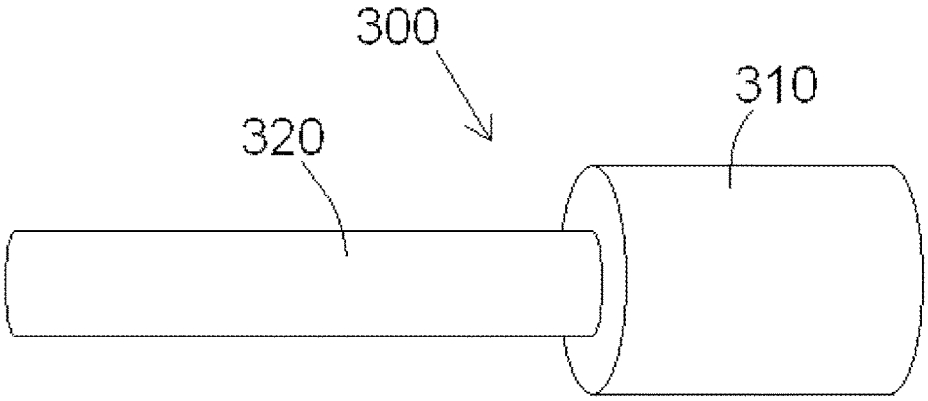
FIG. 4 is a perspective view of a wire insertable into the first connector.

In another embodiment, the first connector 100 electrically connects a wire 300 shown in FIG. 4 to the first circuit board 10. The wire 300, as shown in FIG. 4, has a conductor 320 and an outer insulation layer 310 covering a portion of the conductor 320. The conductor 320 is inserted between the elastic clamps 131, 132 and clamped therebetween; the wire 300 is electrically connected to the first circuit board 10 through the first connector 100. The protrusions 110*a* clamp the outer insulation layer 310 of the wire 300 so as to fix the inserted wire 300 onto the first connector 100.

What is claimed is:

1. A connector assembly, comprising:

a first connector consisting of a first monolithically formed conductive terminal adapted to be soldered onto a first circuit board, the first connector is a female connector having a pair of elastic clamps and a release mechanism, the release mechanism including:

(a) an elastic cantilever;

(b) a pressing portion disposed on an end of the elastic cantilever; and (c) a wedge-shaped protrusion disposed on the pressing portion and inserted between the pair of elastic clamps to separate the pair of elastic clamps in a direction away from each other, the release mechanism movable to separate the pair of elastic clamps in the direction away from each other; and a second connector consisting of a second monolithically formed conductive terminal adapted to be soldered onto a second circuit board, the first connector mating with the second connector to electrically connect the first circuit board to the second circuit board, the second connector is a male connector and has a rod plug inserted between the pair of elastic clamps, the release mechanism releases the rod plug.

2. The connector assembly of claim 1, wherein each of the elastic clamps has a guiding bevel on an end guiding the wedge-shaped protrusion between the pair of elastic clamps.

3. The connector assembly of claim 1, wherein the first connector has a first end having a pair of side walls, a top wall, and a bottom wall.

4. The connector assembly of claim 3, wherein each of the elastic clamps extends in a longitudinal direction of the first connector from one of the side walls at the first end.

5. The connector assembly of claim 4, wherein the elastic cantilever of the release mechanism extends in the longitudinal direction of the first connector from the top wall at the first end.

6. The connector assembly of claim 5, wherein the rod plug is inserted into the first end of the first connector.

7. The connector assembly of claim 5, wherein the first connector has a second end opposite to the first end and includes a bottom plate connecting the bottom wall of the first end with a bottom wall of the second end.

8. The connector assembly of claim 7, wherein at least one of the first end and the second end of the first connector has a top planar surface permitting suction by a suction nozzle.

9. The connector assembly of claim 7, wherein each of the first end and the second end of the first connector has a planar bottom surface soldered onto a surface of the first circuit board.

10. The connector assembly of claim 1, wherein the second connector has a body from which the rod plug extends.

11. The connector assembly of claim 10, wherein the body of the second connector has a top planar surface permitting suction by a suction nozzle.

12. The connector assembly of claim 10, wherein the body of the second connector has a planar bottom surface soldered onto a surface of the second circuit board.

13. The connector assembly of claim 10, wherein the rod plug has a smooth arced end inserted between the pair of elastic clamps.

14. A connector soldered onto a circuit board, comprising:

a pair of side walls, a top wall, and a bottom wall at an end thereof with a plurality of protrusions protruding inwardly on the side walls and the top wall;

a pair of elastic clamps adapted to clamp a conductor of a wire inserted into the connector to electrically connect the wire to the circuit board with the protrusions adapted to clamp an outer insulation layer of the wire to fix the wire to the connector; and a release mechanism including:

(a) an elastic cantilever;

(b) a pressing portion disposed on an end of the elastic cantilever; and (c) a wedge-shaped protrusion disposed on the pressing portion and inserted between the pair of elastic clamps to separate the pair of elastic clamps in a direction away from each other, the release mechanism movable to separate the pair of elastic clamps in the direction away from each other and release the conductor of the wire.

15. The connector of claim 14, wherein the connector consists of a monolithically formed conductive terminal.

* * * * *